US005252017A

United States Patent [19]

Hodel

[11] Patent Number: 5,252,017

[45] Date of Patent: Oct. 12, 1993

[54] SETBACK RETAINING WALL AND CONCRETE BLOCK AND OFFSET PIN THEREFOR

[75] Inventor: Gerald W. Hodel, Roanoke, Ill.

[73] Assignee: Wedgerock Corporation, Roanoke, Ill.

[21] Appl. No.: 767,678

[22] Filed: Sep. 30, 1991

Related U.S. Application Data

[62] Division of Ser. No. 648,011, Jan. 30, 1991, Pat. No. 5,161,918.

[51] Int. Cl.[5] ..... E02D 29/02; F16B 15/06

[52] U.S. Cl. ..... 411/446; 52/169.4; 52/562; 52/585; 403/292; 405/284

[58] Field of Search ..... 52/585, 586, 606, 608, 52/609, 611, 593, 169.4, 562; 411/447, 446, 913, 508, 509; 405/284, 285, 286; 403/292, 295

[56] References Cited

U.S. PATENT DOCUMENTS

| | | | |
|---|---|---|---|
| 798,706 | 9/1905 | Rockwell | 52/585 X |
| 3,195,266 | 7/1965 | Onanian | 52/585 X |
| 3,461,631 | 8/1969 | Brugnola | 52/609 |
| 4,825,619 | 5/1989 | Frosberg | 52/585 X |
| 4,920,712 | 5/1990 | Dean, Jr. | 405/286 |
| 5,035,559 | 7/1991 | Nilsen | 411/508 |
| 5,044,834 | 9/1991 | Janopaul, Jr. | 52/562 X |

FOREIGN PATENT DOCUMENTS

| | | | |
|---|---|---|---|
| 2348043 | 8/1974 | Fed. Rep. of Germany | 405/286 |

*Primary Examiner*—Carl D. Friedman
*Assistant Examiner*—Robert Canfield
*Attorney, Agent, or Firm*—McCaleb, Lucas & Brugman

[57] ABSTRACT

A mortarless concrete block retaining wall is formed from special blocks arranged in set-back tiers and interlocked by special offset pins. Each block is trapezoidal in plan view with a pair of vertical holes behind a relatively wide front face. The holes in adjacent tiers are laterally offset. The pins have opposite end sections which are laterally offset from one another and fit respectively in the offset holes to interlock adjacent tiers in set-back relation. The special pins are rotatably adjustable to interlock the tiers in a straight configuration or in varying degrees of convex and concave curved configurations.

5 Claims, 7 Drawing Sheets

SETBACK RETAINING WALL AND CONCRETE BLOCK AND OFFSET PIN THEREFOR

This application is a division of co-pending patent application Ser. No. 07/648,001 filed Jan. 30 1991 now U.S. Pat. No. 5,161,918.

CROSS REFERENCE TO RELATED APPLICATIONS

This application covers a concrete block retaining wall using set-back tiers of blocks interlocked by offset pins. A preferred form of block for this purpose is shown in applicant's U.S. design application, Ser. No. 7/636,999, filed Jan. 3, 1991, and a preferred form of offset pin is shown in applicant's design application, Ser. No. 07/637,004, filed Jan. 3, 1991.

BACKGROUND OF THE INVENTION

The field of this invention is mortarless retaining walls.

Mortarless concrete block retaining walls have the advantages that they are inexpensive, easy to construct with unskilled labor, have long life, and will adapt to ground subsidence which could crack a poured concrete or mortared wall.

Many mortarless retaining walls have been constructed, using a wide variety of materials. Conventional mortarless retaining walls used to hold earth embankments are typically made of poured concrete, blocks of stone and concrete, and railroad ties. To provide adequate strength and long life, a retaining wall preferably is tilted somewhat into the embankment. The tiers of concrete blocks are progressively set back from lower tiers. In Dean Jr., U.S. Pat. No. 4,920,712, tiers of concrete blocks are held in progressively set-back relation by a complex arrangement of metal clips which hook into apertures in the back walls of individual blocks. This is costly and making curved walls with these blocks and clips is difficult and requires considerable skill. For example, to make a wall with an outside curvature (that is, outwardly convex) certain ears that are required for a straight wall must be carefully and precisely knocked off.

In Forsberg, U.S. Pat. Nos. 4,825,619 and 4,914,876, tiers of concrete blocks are progressively set back by a complex arrangement of multiple through-holes, cavities, recesses and pockets in blocks which are interlocked by pins extending from holes in one tier of blocks into arcuate pockets in blocks of the next tier above or below. These arcuate pockets plus a special recess are in the top surface of each block but are not the bottom surface (and vice versa), so the top and bottom surfaces are different and not interchangeable. Care must be exercised to keep the proper side of the block up or down while assembling a wall. Further, there are severe limitations in the minimum wall curvatures possible with any one configuration of the arcuate pockets required in the individual blocks.

These and other disadvantages of conventional retaining walls are overcome by the special wall blocks and offset pins of the present invention which will now to be described.

SUMMARY OF THE INVENTION

A general object of this invention is to provide a mortarless retaining wall which is inexpensive, easy to construct with unskilled labor, having adjacent tiers permanently interlocked in a predetermined set-back relationship, in a straight configuration, or in a wide range of optional convex and concave curved configurations.

In particular, the object of this invention is to provide a special concrete block and a special offset pin for interlocking a plurality of such blocks when arranged side by side in successive set-back tiers to thereby provide an improved, mortarless retaining wall.

One form of the improved block consists of a body which has an identical trapezoidal configuration in top and bottom plan views and has a relatively longer front face than rear face with a pair of vertical holes at front corner portions.

Alternatively another form of the improved block, for sharply curved walls, is characterized by a pair of straight, vertical through-holes each having an enlarged end portion to enable the offset connection pins to be swung through a wider range than would be possible with through-holes having the same diameter from end to end. More particularly, it is an object of this invention to provide a pair of hole means each comprising opposite, axially aligned hole end portions, one of which is elongated, perferably rectangularly, in a direction parallel to the front face of the block.

The offset pin consists of a body which has opposite laterally offset sections respectively engageable with corresponding holes in blocks in successive tiers to positively interlock the tiers and set back the blocks a predetermined amount in each tier relative to the blocks in a lower tier.

Another object is to provide an inexpensive, mortarless wall readily assembleable from a single set of identical blocks and identical offset pins, to provide a wide choice of convex and concave curved configurations in addition to a straight configuration.

Other objects and advantages will be apparent from the following description taken in connection with the accompanying drawings.

DESCRIPTION OF PREFERRED EMBODIMENTS

Figure 1:
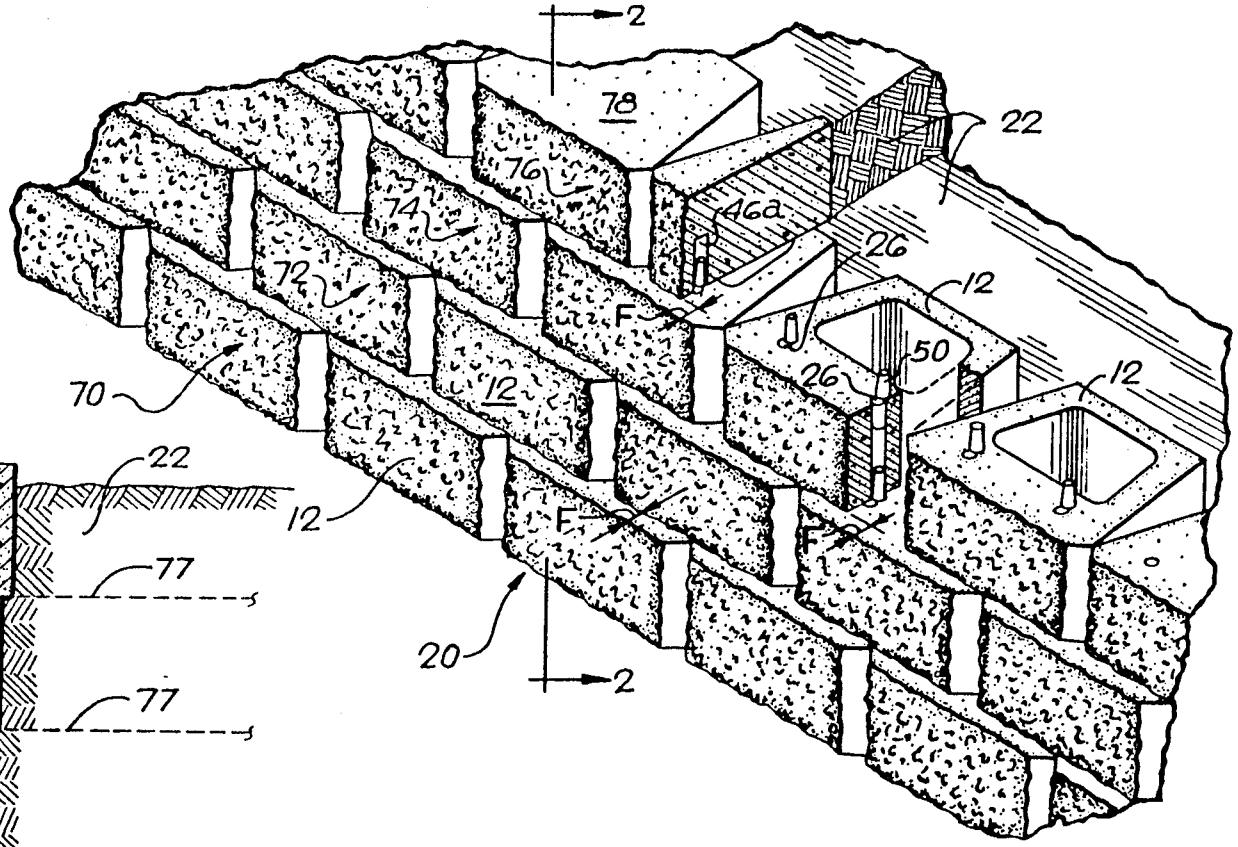
FIG. 1 is a perspective view of a retaining block wall constructed according to the present invention, partially cut away to show detail.
Figure 2:
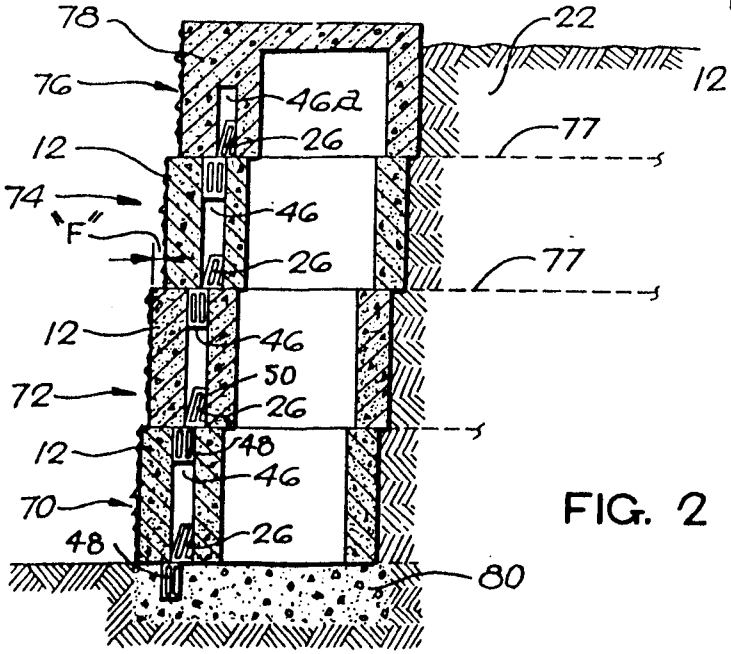
FIG. 2 is a vertical cross sectional view of FIG. 1 taken generally along line 2—2.
Figure 14:
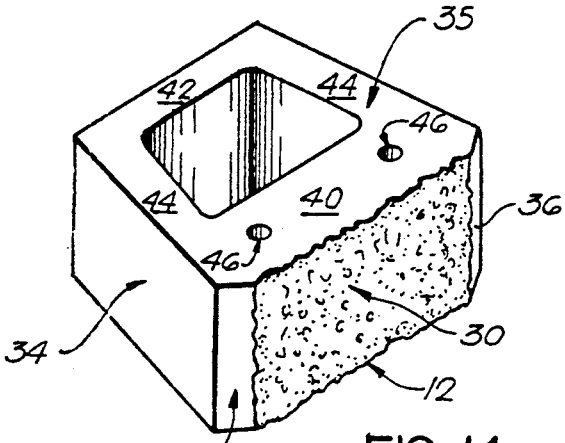
FIG. 14 is a perspective view of a preferred embodiment of a concrete block forming part of the present invention.
Figure 15:
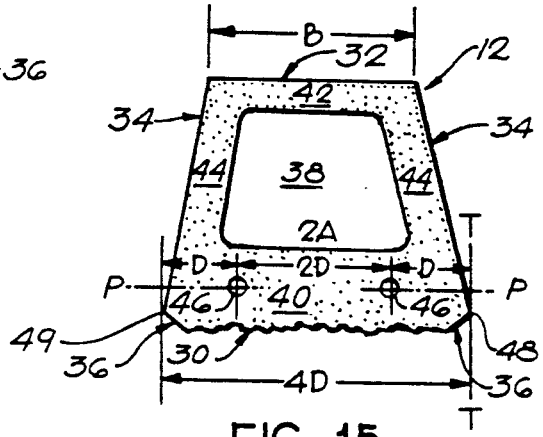
FIG. 15 is a top plan view of FIG. 14 showing dimensions of a specific block which has been used in connection with the offset pin shown in FIGS. 11–13.
Figure 13:
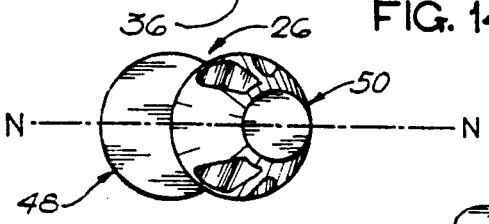
FIG. 13 is a top plan view of FIG. 11.
Figure 11:
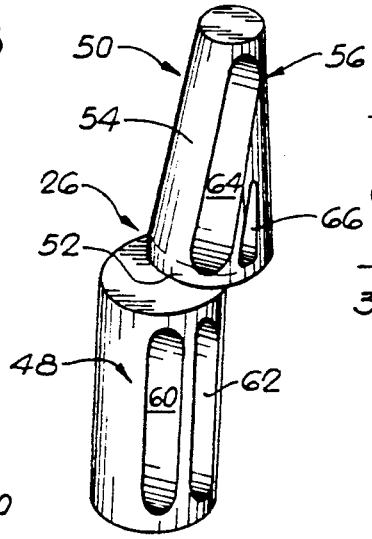
FIG. 11 is a perspective enlarged view of a preferred form of offset pin.
Figure 16:
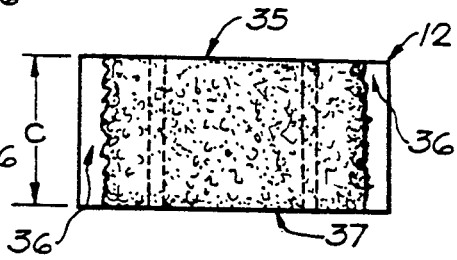
FIG. 16 is a front view of FIG. 15.

FIGS. 1 and 2 show a retaining wall generally designated 20 holding an earth embankment 22 in place. Wall 20 comprises tiers of identical blocks 12 interlocked together by offset pins 26. The blocks 12 and pins 26 have special configurations according to the present invention. All the blocks 12 are identical as best shown in FIGS. 14–16. All the offset pins are identical as best shown in FIGS. 8 and 11–13.

Figure 5:
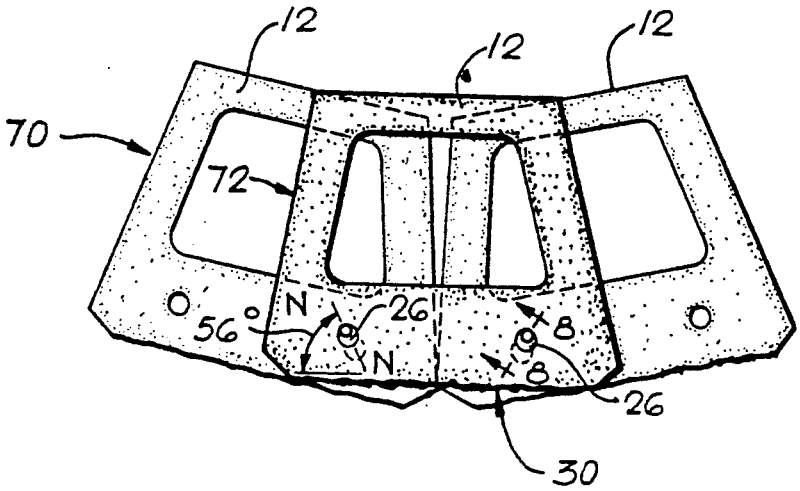
FIG. 5 is a view similar to FIG. 3 showing a fragmentary convex curved wall.
Figure 6:
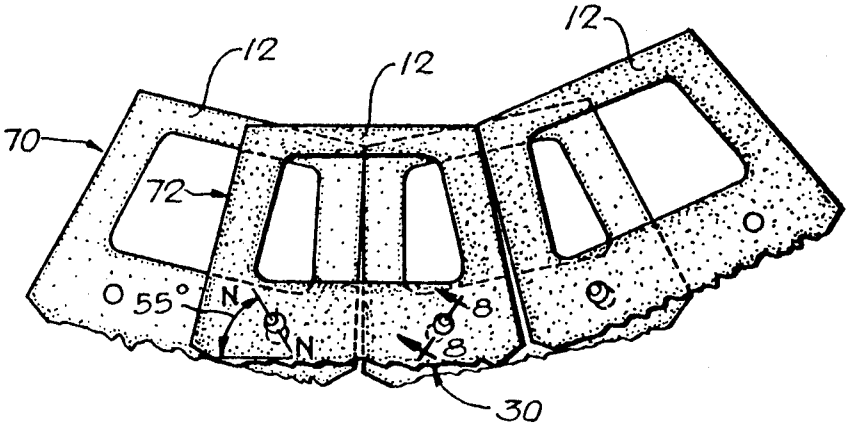
FIG. 6 is a view similar to FIG. 5 showing another fragmentary curved convex configuration.

Block 12 is a unitary member preferably of high density concrete. As best shown in FIGS. 14–16, actual dimensions of one representative block are given. It comprises a body, identically trapezoidal in top and bottom plan views, the width 4D of the front surface 30 being 16" and the width B of the rear surface 32 being 11". This trapezoidal shape readily enables the blocks to form a convex wall as illustrated in FIGS. 5 and 6. The height C of the block is 7⅜ and it has straight, diagonal side surfaces 34,34, and top and bottom horizontal surfaces 35 and 37 respectively. The front surface includes relatively smooth diagonal vertical corner surfaces 36,36 to provide an attractive ornamental effect in a wall face.

The block has a generally trapezoidal-shaped recess 38 extending completely through the block. It is defined by front and rear webs 40,42 and side webs 44,44. One inch diameter (or slightly larger for clearance) vertical through-holes 46 extend completely through the front corner portions of the block at equal distances from the side walls.

As shown in FIG. 15, the spacing 2D between the centers of the holes 46 is 8" and the spacing D between the holes and each corresponding side is 4". As a general relationship, for other sizes of blocks, the holes 46 are located in a vertical plane P—P parallel to the front face 30 in positions equally spaced a distance D from the transverse vertical plane T—T which intersects each maximum-width corner 48 of the block. The general relationship is:

D = the distance between the center of a hole 46 and the corresponding maximum width point of the block as above defined;

2D = the center-to-center distance between holes 46,46; and

4D = the maximum width of the block, between points 48,48 in the present example.

This special relationship enables the blocks to be assembled in a wall side by side and in abutting relation in successive tiers without excessive space or crowding between adjacent blocks through a wide range of convex, concave and straight configurations.

Referring to offset pin 26, best shown in FIGS. 8, 11, 12 and 13, this may be any suitable size. Actual dimensions of one representative size which has been used successfully with blocks dimensioned as shown in FIG. 15 and 16 are given in the description of FIG. 12.

The offset pin 26 may be made of any suitable material, preferably a one-piece injection-molded plastic material such as polyethylene or nylon. The pin 26 comprises a body with opposite offset end sections 48 and 50. Section 48 is cylindrical having a 1" diameter to fit in one of the plus-1" holes 46 in the block 12. Section 50 is generally conical with a short 1" diameter cylindrical base portion 52 and an upper, tilted conical portion 54. The base portion 52 has a 1" diameter to fit in a 1" diameter hole 46 in an upper tier to interlock adjacent tiers.

Figure 8:
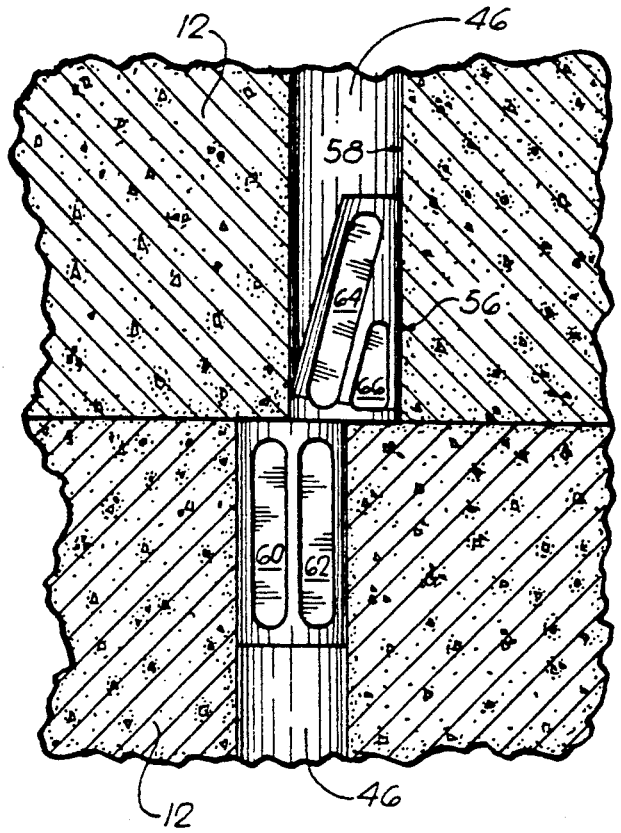
FIG. 8 is an enlarged cross sectional view of FIGS. 3, 4, 5, 6 and 7 taken on lines 8—8.
Figure 12:
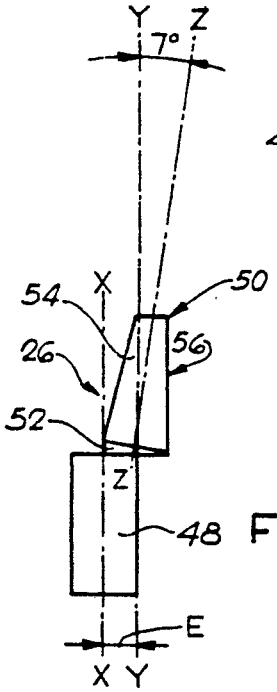
FIG. 12 is a side view of FIG. 11 showing specific dimensions for one example of the pin.
Figure 17:
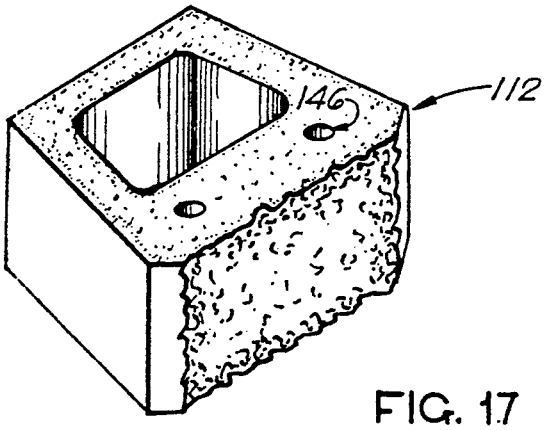
FIG. 17 is a perspective view of an alternate form of concrete block embodying the present invention.

The cylindrical section 48 and cylindrical base portion 52 extend along spaced parallel axes X—X and Y—Y which in the present example are offset E=½" to provide a set-back of ½" in successive tiers. If a different setback is desired, the offset E built into the pins would be different; and the diameter of the pin sections, and holes in the block may be different. The conical portion 54 enables a block to be assembled onto a block in a lower tier without first precisely registering the holes 46 in the respective blocks. The conical shape guides the upper block precisely into the desired set-back position as it is lowered to engage the cylindrical base portion 52. The axis Z—Z of conical portion 54 is tilted (to the right in FIG. 12) at an angle sufficient to bring conical side surface 56 into engagement with an inside vertical surface portion 58 of hole 46 in an upper tier block 12 as best shown in FIGS. 8 and 12. As shown in FIG. 12 the angle of tilt of the cone portion axis Z—Z is about 7°. This substantial longitudinal engagement of the upper conical section with the corresponding block along vertical surfaces 56 and 58 effectively and precisely interlocks blocks in the successive tiers.

Grooves 60, 62, 64, 66 (FIGS. 8 and 11) are provided in the pin sections to conserve material, lighten weight, facilitate injection-molding efficiency, and control shrinkage.

In the example shown in FIGS. 1 and 2, the retaining wall 20 has tiers 70,72 and 74 comprising blocks 12 positioned side-by-side in each tier; and a top tier 76 of cap pieces 78 which as illustrated are identical to the blocks 12 except they are solid on the top surface, and the holes 46a extend only part way up from the bottom surfaces.

Figure 3:
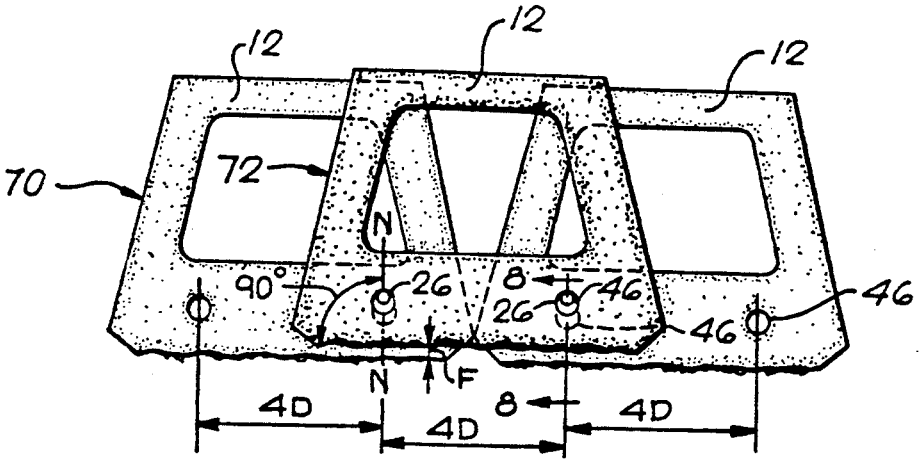
FIG. 3 is a fragmentary top view of the wall shown in FIGS. 1 and 2.

The wall is constructed by laying the first tier 70 of blocks 12 on a suitable bed of compacted granular fill 80 (FIG. 2). Cylindrical pin sections 48 extend down into the fill to stabilize the wall. A second set of pins 26 will be inserted, cylindrical section 48 down, into the upper ends of holes 46 of the blocks in tier 70 with their central plane N—N (FIG. 13) at right angles to the front face in a straight wall. See FIG. 3. Blocks 12 comprising the second tier 72 will then be placed on tier 70 with the upper conical pin sections 50 received in the lower end portions of holes 46. Two of the blocks 12 in the first tier 70 and one of the blocks in the second tier 72, so connected by a pair of pins 26, are shown in FIG. 3. FIG. 8 shows a much enlarged cross-section of one of the pins in this position with the surrounding block portions. This arrangement will be duplicated through tiers 70 and 72 to interlock them in precise set-back determined by the offset of the pins 26. In the present example, that set-back F is ½". Similarly, tier 74 will be assembled and interlocked by pins 26 onto tier 72 in ½" set-back relation, and the cap pieces 78 in tier 76 will be assembled and interlocked onto tier 74 in ½" set-back relation. Conventional mesh sheets 77 (FIG. 2) may be used to tie the wall into the embankment.

Figure 4:
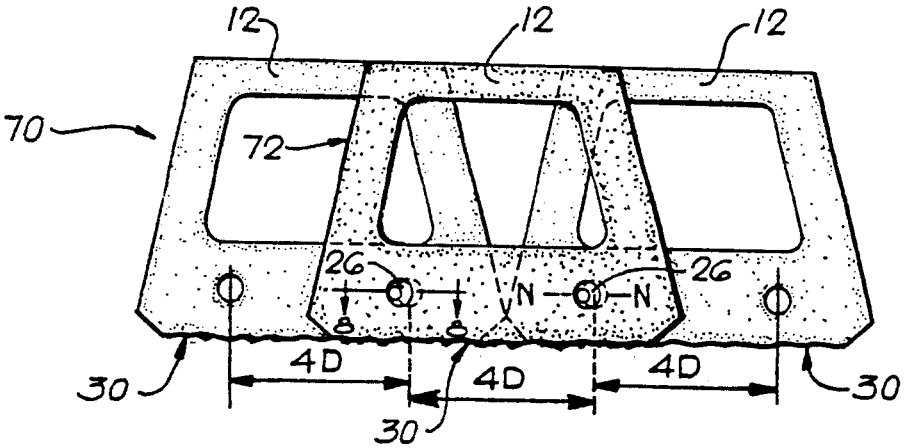
FIG. 4 is an optional fragmentary wall arrangement similar to FIG. 3.

An alternative form of straight wall is shown in FIG. 4 with no set-back. There, the pins 26 are oriented with their central planes N—N parallel to the front faces 30.

FIGS. 5 and 6 show portions of a convex curved wall constructed with the blocks 12 and offset pins 26. In FIG. 5, the angle of the pin central plane N—N relative to the front surface 30 is about 56° and the same angle in FIG. 6 is about 55°, compared with 90° in FIG. 3.

Figure 7:
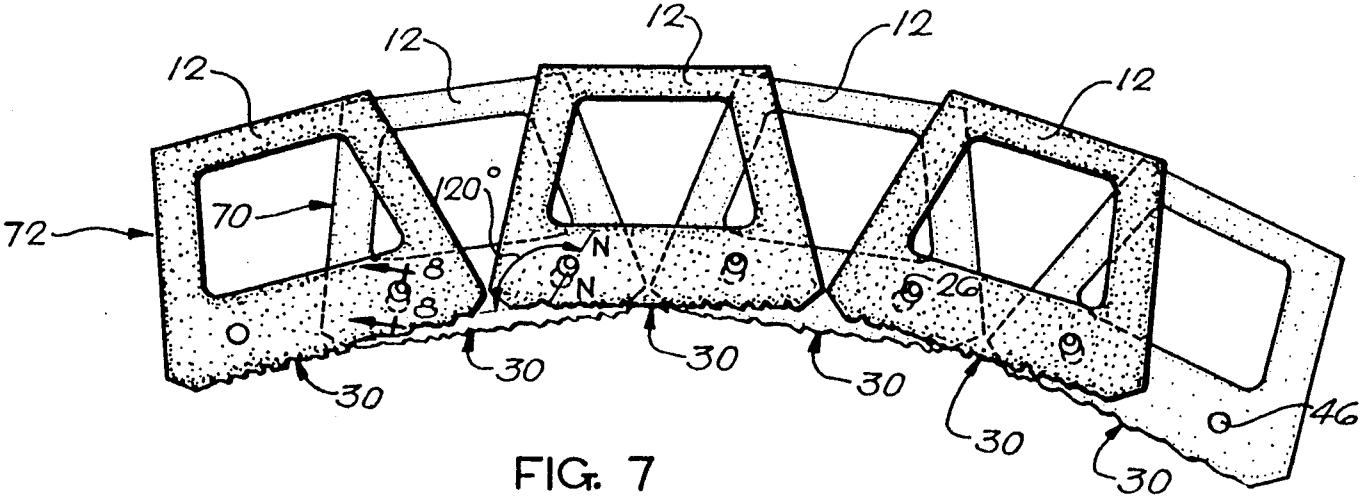
FIG. 7 is a fragmentary top view of a wall with the blocks arranged in concave curved configuration.

FIG. 7 shows a portion of a concave curved wall constructed with the blocks 12 and offset pins 26. In this particular configuration, by comparison with FIGS. 5 and 6, the angle of the pin central plane N—N relative to the front face 30 is about 120°.

Figure 9:
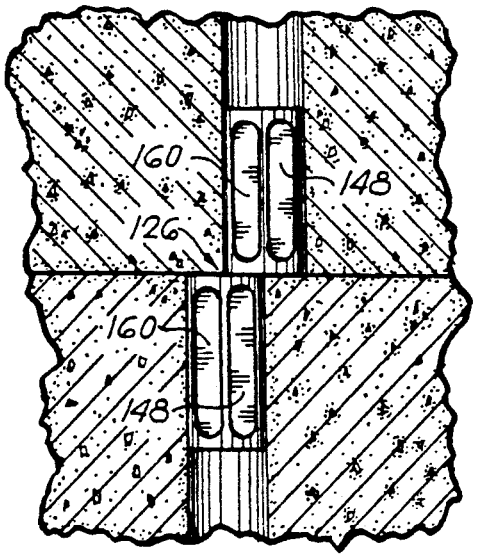
FIGS. 9 and 10 are views similar to FIG. 8 showing alternative forms of offset pins.
Figure 10:
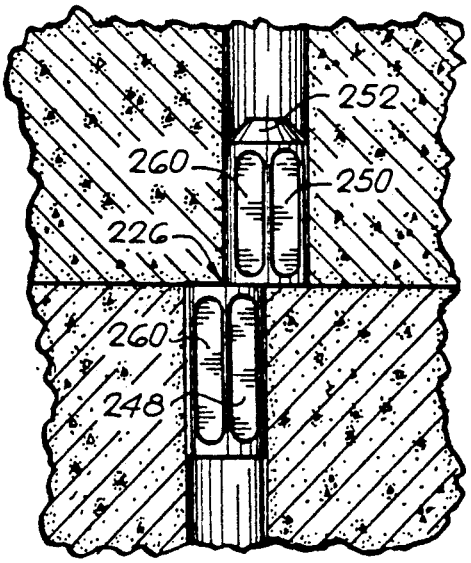

Alternative forms of offset pins 126 and 226 are shown in FIGS. 9 and 10 respectively. Pin 126 comprises two cylindrical sections 148,148 which are the same and may be identical to cylindrical section 48. Pin 226 comprises a lower cylindrical section 248 which may be identical to cylindrical section 48 and an upper cylindrical section 250 having an upper, chamfered end 252. Grooves 160 and 260, similar to grooves 60–66 may be provided in pins 126 and 226.

Figure 19:
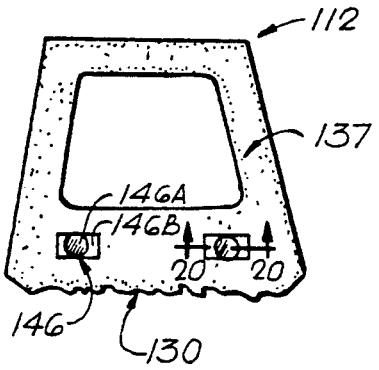
FIG. 19 is a bottom plan view of FIG. 17.
Figure 18:
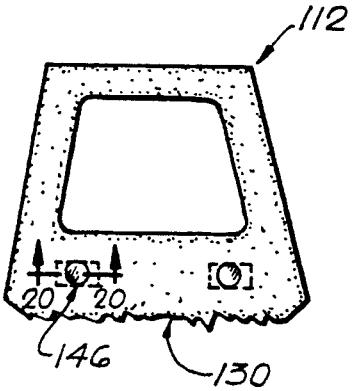
FIG. 18 is a top plan view of FIG. 17.
Figure 20:
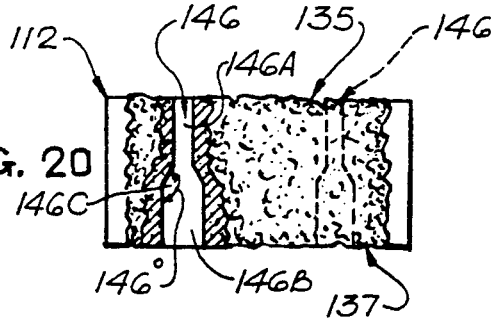
FIG. 20 is a front view of FIG. 17 with the block partly sectioned along lines 20—20 in FIGS. 18 and 19.

Referring now to the alternate form of concrete block shown in FIGS. 17–21, this is shown as identical to block 12 described above, except for the vertical hole means which are specially contoured to facilitate constructing walls with relatively small radius curves. This alternate block is generally designated 112 and each of the vertical hole means is designated 146. Each hole means comprises an upper end portion 146A and a lower end portion 146B joined by an intermediate section 146C defined by a wall inclined at 146° as shown in FIG. 20.

It will be appreciated that the dimensions given for the blocks, hole means, and pins in this description are merely for purposes of illustration and are not limiting in any way. The specific dimensions given may be varied widely in practicing this invention. For example, while the hole means 46 is illustrated in FIG. 15 as slightly more than 1" diameter to accommodate 1" diameter offset pins 26, 126 and 226, these hole means may start out with 1⅛" diameter to allow for mold abrasion by the sand and concrete raw materials. This abrasion wears away the mold rods which define the holes in the concrete, making the resultant holes in the concrete blocks smaller and smaller throughout a production run.

Referring now to the bottom view of block 112 in FIG. 19, the lower hole portion 146B is elongated in the lower surface 137. Further, end portion 146B is elongated in a direction parallel to the front face 130. More specifically, in FIG. 19, each hole end portion 146B is rectangular with a long dimension of 2¼" and a short dimension of 1⅛", the latter matching the diameter of the round cross section in opposite hole end portion 146A.

Figure 21:
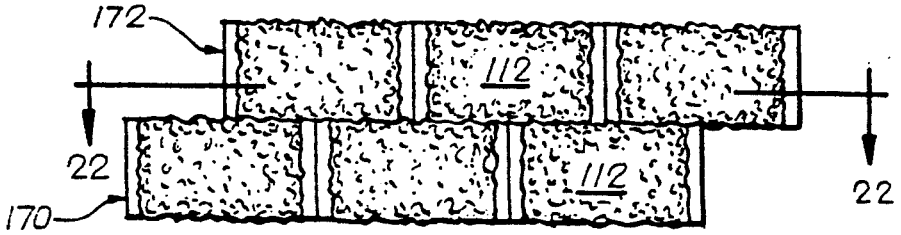
FIG. 21 is a fragmentary front view of a wall constructed of the blocks shown in FIGS. 17–20.
Figure 22:
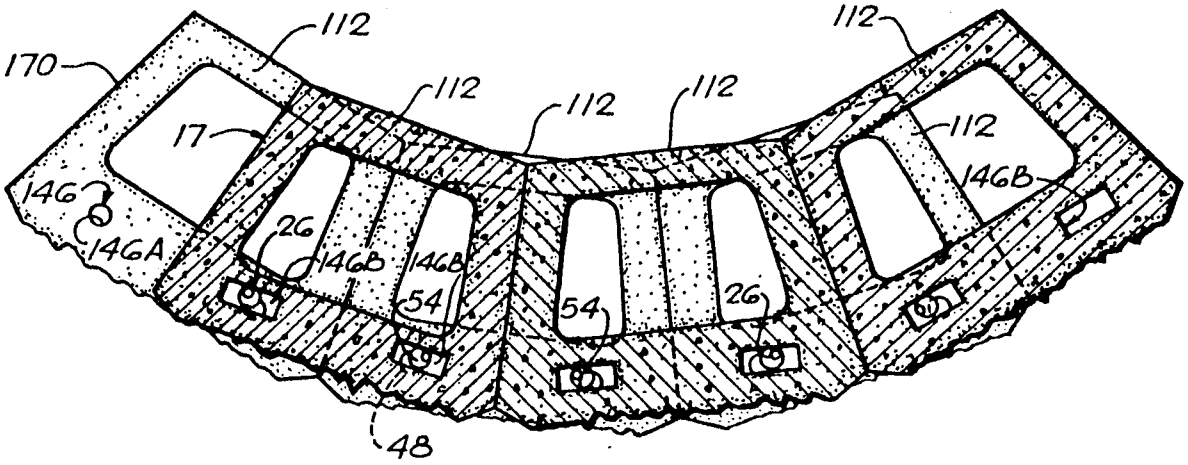
FIG. 22 is a horizontal sectional view of FIG. 21 taken along line 22—22.

FIGS. 21 and 22 show a portion of a convex, curved wall constructed of the alternate blocks 112 interconnected by pins 26. In this case, the cylindrical pin sections 48 will be fitted in the round cross section upper hole end section 146A in lower tier 170, and the conical section 54 will be fitted in the lower, rectangular shaped hole end section 146B in upper tier 172. As shown in FIG. 22, the upper conical pin sections 54 will be oriented at appropriate, different angles to accommodate the small radius wall shown. While two tiers 170 and 172 are shown in FIGS. 21 and 22, in an actual wall, additional tiers will be constructed as determined by the height requirement for the job.

Figure 23:
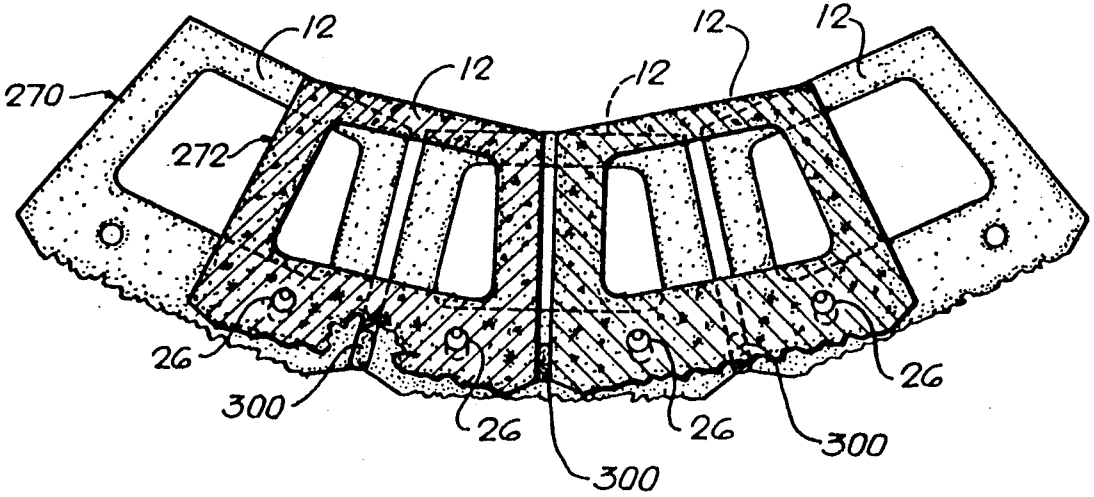
FIG. 23 is a fragmentary top view similar to FIG. 6 of an alternate form of wall constructed with the concrete blocks shown in FIGS. 14–16.

Referring to FIG. 23, an alternative wall construction is illustrated using blocks 12 interconnected by pins 26. There is a first, lower tier section 270 with three blocks 12 and a second, upper tier 272 illustrated with two blocks 12. In very tight, small-radius curved walls, where the upper tiers are progressively set back from the lower tiers, the adjacent blocks may be spaced apart in decreasing amounts in successively upper tiers. For example as shown in FIG. 23 the blocks in the lowest tier 270 are spaced apart ¾". In the next tier 272 they are spaced ½" apart. In the third and fourth tiers (not shown) the blocks would be spaced apart ¼" and 0" respectively. This would be a four-tier wall with the top tier being cap blocks such as those designated 78 in FIGS. 1 and 2. If desired, filler material 300 may be placed in the spaces between the blocks. This may be of any suitable material such as plastic, wood, styrofoam, or mortar. Alternatively, this filler material may be selectively omitted or purposely made with some porosity to allow for drainage while still retaining the earth fill behind the wall.

While particular examples of the invention have been shown and described, changes and modifications may be made therein without departing from the invention in its broadest aspects. The aim of the appended claims, therefore, is to cover all such changes and modifications included within the spirit and scope of the invention.

The embodiments of the invention in which an exclusive property or privilege is claimed are defined as follows:

1. An offset pin for engagement in a pair of laterally offset holes in adjacent, abutting upper and lower surfaces of a pair of blocks to interlock a plurality of such blocks when arranged side by side in lower and upper setback tiers to form a wall having a predetermined upward slope;

each said pin comprising a body with a pair of opposite end sections being laterally offset about a pair of spaced, parallel axes, at least part of each said end section having a circular cross section and engageable respectively in a corresponding one of such laterally offset holes in adjacent, abutting, upper and lower surfaces of a pair of blocks;

said opposite end sections having oppositely facing laterally offset shoulders which are in a common plane normal to said axes for engagement with such abutting upper and lower surfaces of a pair of blocks.

2. An offset pin according to claim 1 in which said opposite end sections are elongated and have cylindrical portions engageable respectively within cylindrical holes in upper and lower blocks to interlock said blocks against lateral movement.

3. An offset pin according to claim 1 in which one of said end sections is generally cylindrical and the other of said end sections is generally conical.

4. An offset pin according to claim 3 in which the generally cylindrical end section extends along one of said pair of spaced parallel axes; and the generally conical end section extends along an axis suitably angularly disposed relative to said one of said pair of spaced parallel axes to enable a wall portion of the conical section remote from the cylindrical section to extend along a line which is in spaced substantially parallel relation to said one of said pair of spaced parallel axes.

5. An offset pin according to claim 4 in which the generally conical end section has a cylindrical base portion adjacent said generally cylindrical end section, said cylindrical base portion having substantially the same diameter and cross section as the generally cylindrical end section and extending along the other of said pair of spaced parallel axes.

* * * * *